US006695671B2

(12) United States Patent
Kessler

(10) Patent No.: US 6,695,671 B2
(45) Date of Patent: Feb. 24, 2004

(54) AMUSEMENT DEVICE OR PLAYTHING

(75) Inventor: Brian D. Kessler, Los Angeles, CA (US)

(73) Assignee: Maui Toys, Inc., Los Angeles, CA (US)

( * ) Notice: Subject to any disclaimer, the term of this patent is extended or adjusted under 35 U.S.C. 154(b) by 0 days.

(21) Appl. No.: 10/207,200

(22) Filed: Jul. 30, 2002

(65) Prior Publication Data

US 2003/0027484 A1 Feb. 6, 2003

Related U.S. Application Data

(60) Provisional application No. 60/308,597, filed on Jul. 31, 2001.

(51) Int. Cl.[7] ..... A63H 1/06

(52) U.S. Cl. ..... 446/247; 446/242; 482/81

(58) Field of Search ..... 482/81, 79, 110; 446/236, 241, 242, 243–245, 247, 265, 266, 175, 484, 485

(56) References Cited

U.S. PATENT DOCUMENTS 3,140,871 A * 7/1964 Liquori ..... 446/26
3,528,654 A * 9/1970 Larson et al. ..... 446/26
3,548,185 A 12/1970 Hall
3,935,669 A * 2/1976 Potrzuski et al. ..... 446/485
4,043,076 A 8/1977 Potrzuski et al.
4,445,297 A 5/1984 Andrade et al.
4,648,610 A 3/1987 Hegyi
4,875,675 A * 10/1989 Arad et al. ..... 446/247
5,138,535 A 8/1992 Aragon et al.
5,356,328 A 10/1994 Ho
5,603,651 A * 2/1997 Shure et al. ..... 446/16
5,629,068 A 5/1997 Miekka et al.
5,823,846 A 10/1998 Arriola
5,902,166 A 5/1999 Robb
6,001,048 A 12/1999 Taylor
6,113,452 A * 9/2000 McGowan et al. ..... 446/146
6,171,171 B1 1/2001 Barthold
6,220,733 B1 4/2001 Gordon
6,482,136 B1 * 11/2002 Kessler ..... 482/110

* cited by examiner

*Primary Examiner*—Derris H. Banks
*Assistant Examiner*—Bena B. Miller
(74) *Attorney, Agent, or Firm*—Browdy and Neimark, P.L.L.C.

(57) ABSTRACT

An amusement device, particularly for use by children for jumping or skipping, has a ring through which one foot is placed, and a tube or rod extending therefrom with a wheel at the far end of the rod or tube. The wheel contains some small lamps and a generator, whereby rotation of the wheel causes the lamps to light. The connector rod or tube is wrapped with holographically printed film.

8 Claims, 2 Drawing Sheets

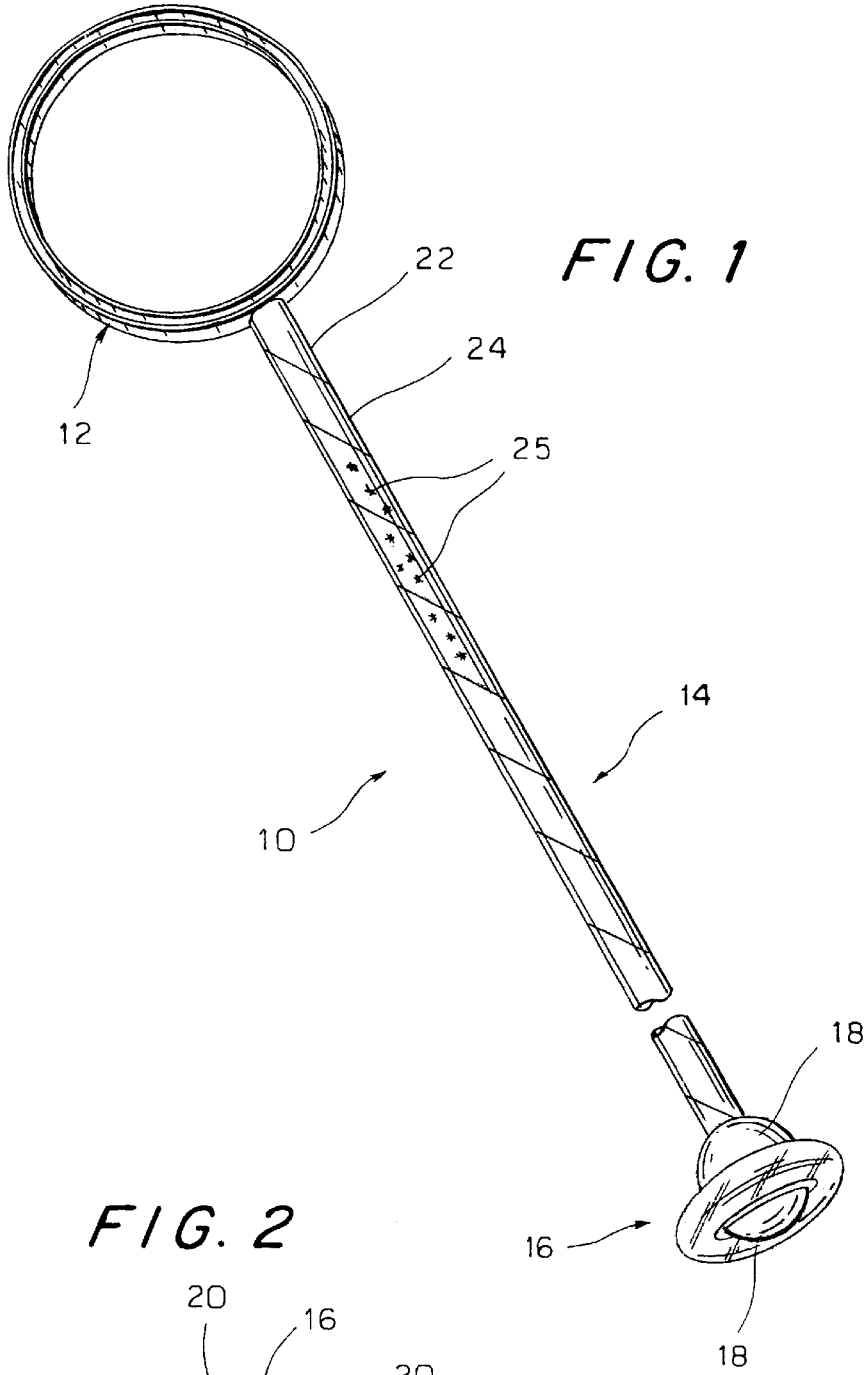
FIG. 1
FIG. 2
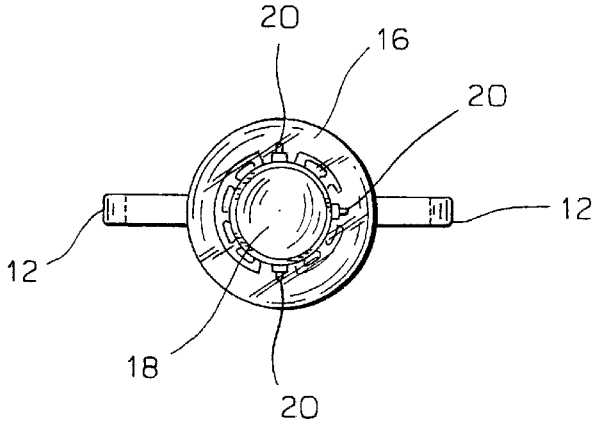

AMUSEMENT DEVICE OR PLAYTHING

This application claims the benefit of provisional application 60/308,597 fild Jul. 31, 2001.

FIELD OF INVENTION

The present invention relates to an improvement in a game or amusement device particularly used by children for jumping or skipping, and having a ring through which one foot is placed, and whereby the user rotates the ring part of the device about the foot while hopping over an elongated element which extends from the ring.

BACKGROUND OF THE INVENTION

Devices of the above general type are known, and these include the aforementioned ring at one end, the elongated element, e.g. a rope-like element, hereinafter referred to as a "connector" extending therefrom, and a wheel, e.g. a counter-wheel, at the opposite end of the connector from the ring. The wheel provides both a weight at the opposite end of the connector so as to provide more efficient swinging of the device about the ankle of the user due to the effects of centrifugal force, and also rotates along the ground or other supporting surface in which the device is used, e.g. about an axis generally concentric with the connector.

Wheels containing light generating means are known for use in other devices as disclosed in the U.S. patents to Hegyi U.S. Pat. No. 4,648,610; Hall U.S. Pat. No. 3,548,185; and Gordon U.S. Pat. No. 6,220,733, the contents of all of which are incorporated herein by reference. It is also known to wrap playthings in decorative holographic printed film, noting co-pending Kessler application Ser. No. 09/395,359.

SUMMARY OF THE INVENTION

The present invention is directed to an amusement device of the type indicated above wherein the wheel lights up when it is rotated, and more particularly such an amusement device which does not need a battery and instead uses means within the wheel for generating light, e.g. in accordance with one of the aforementioned patents, or some other type of generator.

BRIEF DESCRIPTION OF THE DRAWING

For a more complete understanding of the present invention, reference is now made to the following description of an embodiment of the invention taken in conjunction with the accompanying drawing figures, in which:

FIG. 1 is a perspective view of a device according to the present invention;

FIG. 2 is an end view thereof; and

DETAILED DESCRIPTION OF EMBODIMENT

Figure 3:
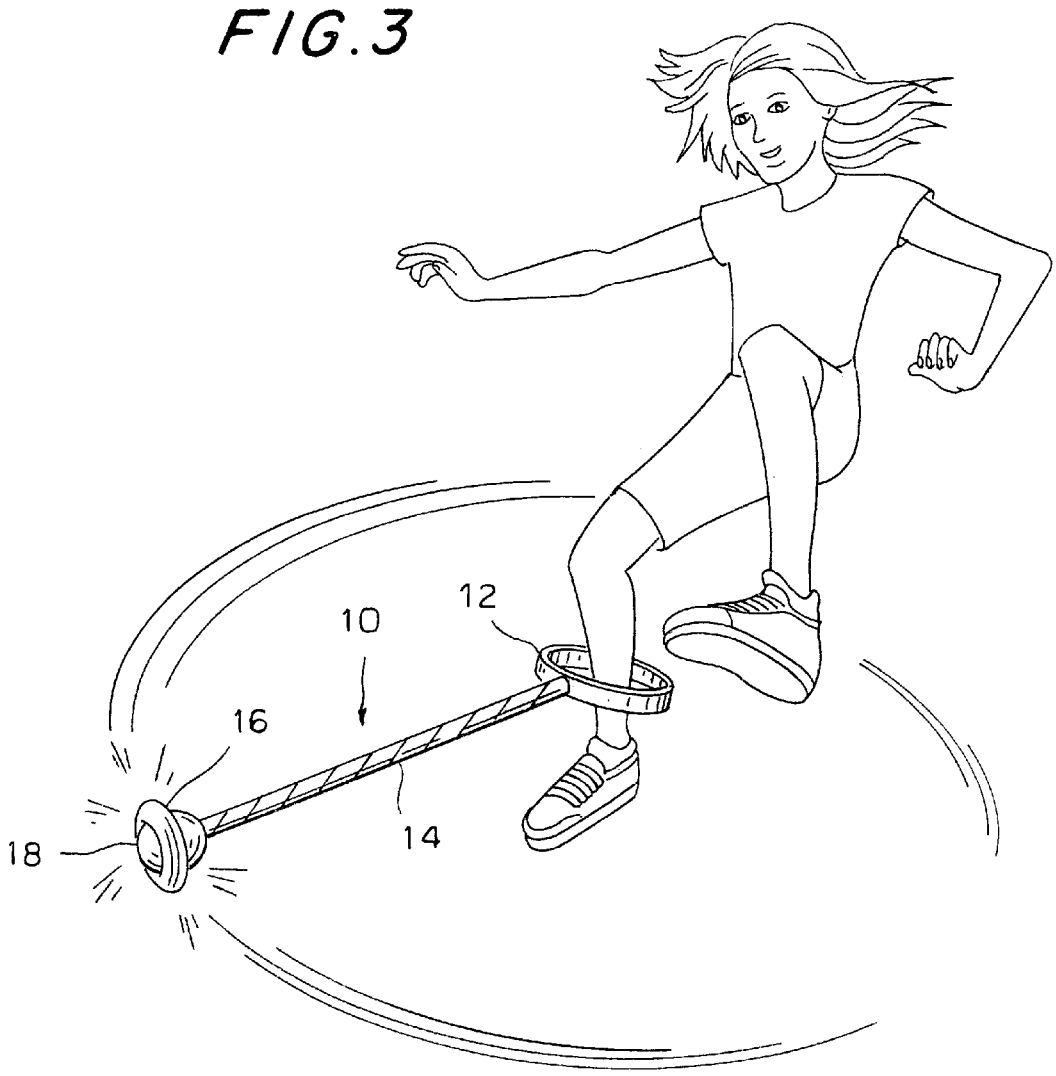
FIG. 3 is a perspective view of the device in use.

An amusement device 10 according to the present invention comprises a ring 12 through which one foot of the user is placed as shown in FIG. 3 for rotation about the leg or ankle of the user, the ring 12 having a connector 14 extending therefrom, the connector 14 preferably being in the form of a relatively rigid or semi-rigid rod or tube. At the opposite end of the connector 14 there is mounted a wheel 16 freely rotatable about its axis which is preferably concentric with the connector rod or tube 14.

In a preferred embodiment, the wheel has a pair of hubs 18 which rotate therewith when the wheel rotates during use of the device as the wheel moves along the surface of use, e.g. the ground or a floor. One end of the connector rod or tube 14 is received within the inner of the two hubs 18, internal structure (not shown) of the wheel 16 supporting the connector rod 14 so that the wheel 16 and the hubs 18 can rotate relative thereto.

The wheel 16 is formed of a transparent or translucent plastic, preferably a hard plastic such as acetal resin, polycarbonate, high impact polystyrene, etc., and may be in accordance with the aforementioned Hegyi U.S. Pat. No. '610 or the aforementioned Hall U.S. Pat. No. '185. As shown in FIG. 2, a series of small lamps 20 are provided internally of the wheel 16 and project radially from the axis thereof, the magneto power source (not illustrated) being provided between or within the hubs 18.

The connector rod or tube 14 is wrapped with a decorative film, preferably a holographic printed plastic film 22 and/or 24, preferably both, to provide a visual effect analogous to a barbershop pole, but with the enhanced effects of the holographic film printed with iridescent sparkles 25 and/or other decorative effects in the form of diffraction rulings to provide scintillating color changes. The combination of the light emitting lamps and the holographic film as the device is used provides a spectacular display. Even the lighting effects produced by the wheel alone, not taking into account the holographic cover film(s) of the connector rod or tube 14, are quite different than the effects produced by battery powered lights.

The connector 14 is preferably, but not necessarily, a plastic tube formed of a rigid or semi-rigid material, such as vinyl plastic, ABS polymer, polyethylene or the like. The ring 12 is desirably made of a softer and less rigid plastic than the connector tube 14, e.g. soft vinyl plastic or a polyethylene somewhat softer than that used in the connector 14. Of course, more expensive materials such as reinforced plastics can be used, but are not preferred. The plastic film having a holographic appearance is preferably provided in two parts and is wrapped about the connector rod or tube 14 in the nature of a barber's pole.

In addition to the improved visual effects which are achieved in the present amusement device 10 from the combination of the holographic printed film and the light emitting lamps, the present device 10 has an added advantage in that there is no need to ever replace any batteries.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. An entertainment device comprising an elongated connector, a ring at one end and a rotatable wheel at the other end of the connector, wherein the rotatable wheel contains lamps and a generator, and wherein said lamps are powered by said generator.

2. The device of claim 1 wherein the connector is rigid or semi-rigid.

3. The device of claim 2 wherein the connector is covered with plastic film having a holographic appearance.

4. The device of claim 1 wherein the connector is covered with plastic film having a holographic appearance.

5. The device of claim 4 wherein the film is in two parts wrapped like a barber's pole.

6. The device of claim 1, wherein said rotatable wheel is made of a hard and transparent plastic selected from the group consisting of acetal resin, polycarbonate and high impact polystyrene.

7. The device of claim 4, wherein said rotatable wheel is made of a hard and transparent plastic selected from the group consisting of acetal resin, polycarbonate and high impact polystyrene.

8. The device of claim 2 wherein said connector is a plastic tube formed of a plastic selected from the group consisting of vinyl plastic, ABS polymer and polyethylene.

* * * * *